US011396083B2

(12) United States Patent
Kaneshige

(10) Patent No.: US 11,396,083 B2
(45) Date of Patent: Jul. 26, 2022

(54) POLISHING LIQUID SUPPLY DEVICE

(71) Applicant: NISHIMURA CHEMITECH CO., LTD., Osaka (JP)

(72) Inventor: Takuji Kaneshige, Osaka (JP)

(73) Assignee: NISHIMURA CHEMITECH CO., LTD., Osaka (JP)

( * ) Notice: Subject to any disclaimer, the term of this patent is extended or adjusted under 35 U.S.C. 154(b) by 334 days.

(21) Appl. No.: 16/705,603

(22) Filed: Dec. 6, 2019

(65) Prior Publication Data

US 2020/0180108 A1 Jun. 11, 2020

(30) Foreign Application Priority Data

Dec. 11, 2018 (JP) ..... JP2018-231467

(51) Int. Cl.
*B24B 5/00* (2006.01)
*B24B 57/02* (2006.01)

(52) U.S. Cl.
CPC ..... *B24B 57/02* (2013.01)

(58) Field of Classification Search
CPC ..... B24B 7/02; B24B 55/02
USPC ..... 451/285, 41, 60, 446
See application file for complete search history.

(56) References Cited

U.S. PATENT DOCUMENTS 4,526,584 A * 7/1985 Funk ..... C10L 1/322 137/13
6,125,876 A * 10/2000 Laederich ..... B24B 37/04 137/255
6,767,124 B2 * 7/2004 Shikami ..... B01F 3/088 366/152.2
7,052,377 B2 * 5/2006 Tanoue ..... B24B 37/04 451/87
9,770,804 B2 * 9/2017 Byers ..... B24B 57/02
10,279,324 B2 * 5/2019 Komazawa ..... B24B 55/02
2002/0141284 A1 * 10/2002 Vogtmann ..... B01F 5/0614 366/181.5

FOREIGN PATENT DOCUMENTS

JP 2017013196 1/2017

* cited by examiner

*Primary Examiner* — Joseph J Hail
*Assistant Examiner* — Shantese L McDonald
(74) *Attorney, Agent, or Firm* — Hamre, Schumann, Mueller & Larson, P.C.

(57) ABSTRACT

Provided is technical means capable of supplying a polishing liquid having a uniform slurry flow rate to a CMP polishing device. There is a blending flow channel 40 communicating with a flow channel in which a slurry, ultra-pure water, a chemical, and hydrogen peroxide water are transferred. In this blending flow channel 40, a plurality of types of liquids are blended, and the blended liquid is supplied to the CMP polishing device 8 as a plurality of polishing liquid. A blending tank 52A storing the polishing liquid obtained by blending the liquids is included. A flow channel reaching the CMP polishing device 8 is a circulation flow channel that returns to the blending tank 52A via a branching point 17A from the blending tank 52A toward the CMP polishing device 8.

4 Claims, 7 Drawing Sheets

POLISHING LIQUID SUPPLY DEVICE

TECHNICAL FIELD

The present disclosure relates to a polishing liquid supply device that supplies a diluted polishing liquid to a CMP (Chemical Mechanical Polishing) polishing device.

BACKGROUND

In a semiconductor manufacturing process, there is a process of performing mechanical chemical polishing on an etched wafer 88, which is called polishing. FIG. 8 is a diagram showing a schematic configuration of a CMP system used in this process. As shown in FIG. 8, the CMP system is composed of a polishing device 8 and a polishing liquid supply device 9. The wafer 88 to be polished is stuck on a sticking plate 82 on the lower surface of a head 81 of the polishing device 8. The wafer 88 is pressed against a polishing pad 84 on a surface plate 3 by this head 81. A polishing liquid obtained by diluting the slurry with ultra-pure water or a chemical is stored in a tank 91 of the polishing liquid supply device 9. When the polishing liquid in the tank 91 of the polishing liquid supply device 9 is sucked out by a pump 92 and the head 81 and the surface plate 83 are rotated while dripping the polishing liquid from the tip of the nozzle 85 onto the polishing pad 84, the surface of the wafer 88 is polished by a mechanical action in which the wafer 88 slides on the polishing pad 84 while being pressed against the polishing pad 84 and a chemical reaction action in which the wafer 88 is in contact with the slurry of the polishing agent. For details of the configuration of the CMP system, see Patent Document 1.

It is known that the polishing shape of the wafer 88 in the CMP system depends on the rotation speed of the polishing pad 84 and the supply performance of the polishing liquid. In order to improve the polishing shape of the wafer 88, it is essential to keep the rotation speed of the polishing pad 84 and the supply amount of the polishing liquid per unit time constant. In general, the amount of polishing removal increases in proportion to the relative speed between the wafer 88 and the polishing pad 84, and the processing pressure.

PRIOR ART REFERENCE

Patent Documents

Patent Document 1: Japanese Patent Application Laid-Open No. 2017-13196

SUMMARY

Problems to be Solved

The conventional CMP device is configured as following: a stirring device is provided in the tank of the polishing liquid supply device; an undiluted slurry solution, ultra-pure water, and an agent called chemical are poured in the blending tank; and a liquid obtained by blending these liquids with a stirring device is supplied to the polishing device as a polishing liquid. However, in such a configuration, there are problems that most of the liquid in the tank stays in the tank for a long time after blending, causing aggregation/precipitation or oxidation, and it is difficult to supply a polishing liquid with a uniform slurry concentration.

The present disclosure has been made in view of such problems, and an object thereof is to provide technical means capable of supplying a polishing liquid with a uniform slurry concentration to a CMP polishing device.

Means for Solving the Problems

In order to solve the above problems, the present disclosure provides a polishing liquid supply device that provides a polishing liquid to a CMP polishing device. The polishing liquid supply device includes: a first flow channel transferring slurry; a second flow channel transferring pure water; and a blending flow channel communicating with the first flow channel and the second flow channel. The blending flow channel is arranged immediately before a liquid outlet that reaches the CMP polishing device, and in the blending flow channel, a plurality of types of liquids including the slurry and the pure water are blended, and the blended liquid is supplied to the CMP polishing device as a polishing liquid.

In this disclosure, the blending flow channel is provided with a mixing unit mixing the slurry and the pure water. The mixing unit is provided with a first inflow port at one end of a hollow cylindrical body, an outflow port at the other end of the cylindrical body, a second inflow port on a side surface of the cylindrical body, and a stirring screw in the cylindrical body. It may be configured to mix while stirring the liquids flowing in from the first inflow port and the second inflow port by passing through the stirring screw.

Further, the blending flow channel is provided with a mixing unit mixing the slurry and the pure water. The mixing unit may be a unit in which a plurality of meshes are arranged side by side in a hollow cylindrical body so that mesh orientation of meshes that follow each other is shifted by a predetermined angle.

Further, a drum storing the slurry, and a pump pumping out the slurry in the drum and supplying the slurry to the first flow channel are included. The first flow channel may be a circulation flow channel that returns to the drum via a branching point from the first flow channel toward the blending flow channel.

Further, one or a plurality of pressurizing tanks provided between the drum in the first flow channel and the branching point, and a gas pressurizing part that sends out inert gas to the pressurizing tank and pushes out the liquid in the pressurizing tank may be included.

Further, the number of the pressurizing tanks is plural. Control means, an open/close valve that is provided in at least one of a liquid inflow port and a liquid outflow port of each of the pressurizing tanks and opens or closes according to a given signal, and a filling amount sensor detecting a filling amount of the liquid in each of the pressurizing tanks and outputting a signal indicating the detected filling amount are included. The control means may recursively repeat the control of closing the open/close valve of the pressurizing tank in which the filling amount becomes less than a predetermined amount and opening the open/close valve of another pressurizing tank.

Effects

According to the present disclosure, the liquid does not stay in the blending tank and aggregation/precipitation does not occur, and a polishing liquid with a uniform concentration can be stably supplied to the CMP polishing device.

DETAILED DESCRIPTION

Hereinafter, embodiments of the present disclosure are explained with reference to drawings.

First Embodiment

Figure 1:
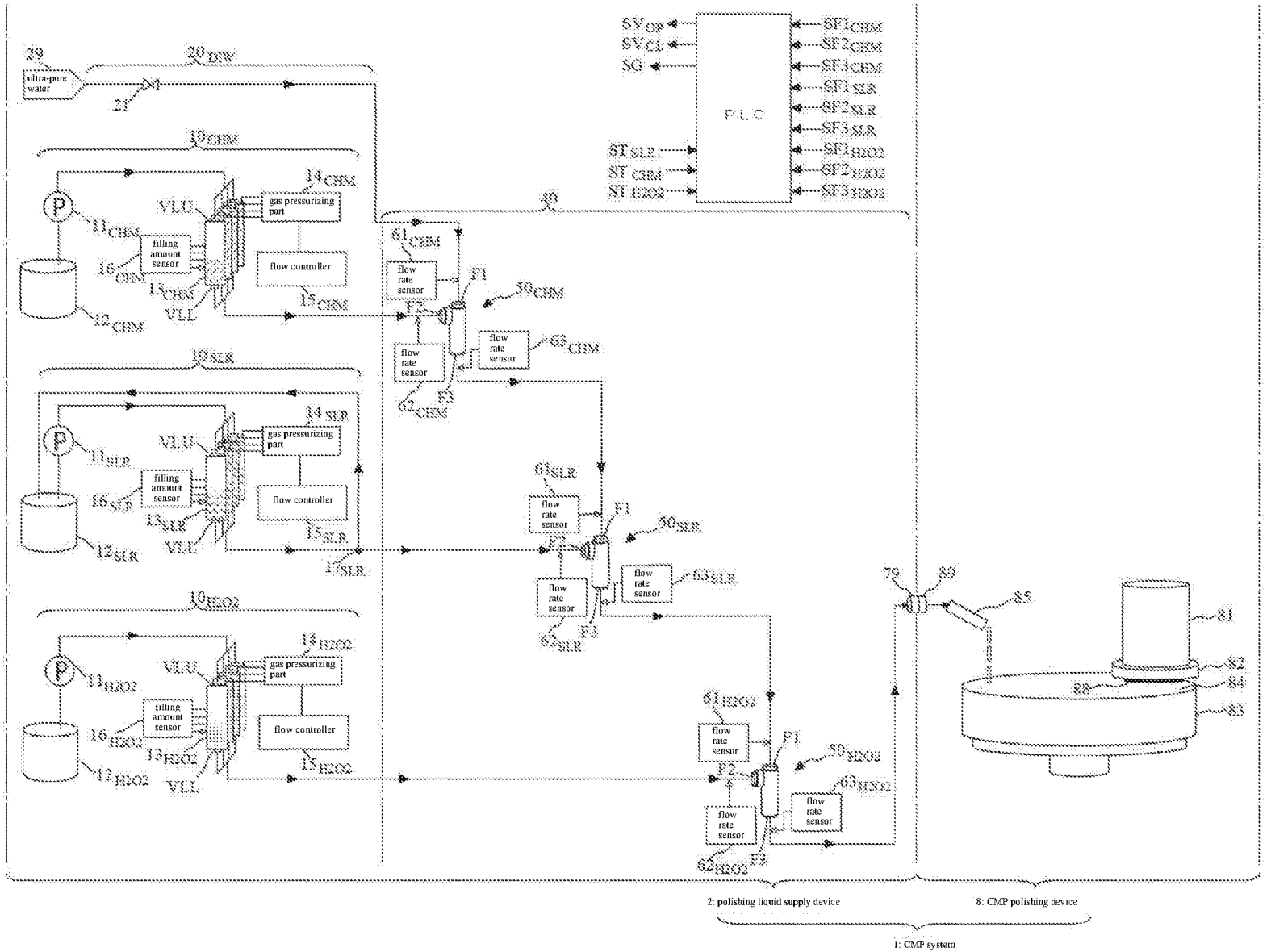
FIG. 1 is a diagram showing an overall structure of a CMP system including a polishing liquid supply device of the first embodiment of the present disclosure.

FIG. 1 is a diagram showing an overall structure of a CMP system 1 including a polishing liquid supply device 2 of the first embodiment of the present disclosure. Solid lines connecting elements in FIG. 1 indicate pipes, and arrows on the solid lines indicate traveling directions of the liquid in the pipes. The CMP system 1 is used in a polishing process of a semiconductor manufacturing process. The CMP system 1 has a CMP polishing device 8 and a polishing liquid supply device 2. A liquid inlet 89 of the CMP polishing device 8 is connected to a liquid outlet 79 of the polishing liquid supply device 2. The CMP polishing device 8 polishes a wafer 88 to be polished. The polishing liquid supply device 2 supplies the polishing liquid to the CMP polishing device 8.

The polishing liquid is a liquid obtained by blending slurry, ultra-pure water, a chemical, and hydrogen peroxide water at a predetermined ratio. Here, the slurry includes slurry including abrasive grain or the like, alkaline slurry including $SiO_2$, neutral slurry including $CeO_2$, and acidic slurry including $Al_2O_3$, and the like. The chemical includes silica, and citric acid and the like. The effective component of the slurry or the chemical may be determined according to the wafer 88 to be polished, the polishing shape, or the like.

The polishing liquid supply device 2 has a PLC (Programmable Logic Controller) 70, an ultra-pure water inlet 29 connected to an external ultra-pure water supply source, a drum $\mathbf{12}_{CHM}$ storing a chemical, a drum $\mathbf{12}_{SLR}$ storing slurry, a drum $\mathbf{12}_{H2O2}$ storing hydrogen peroxide water, a flow channel $\mathbf{20}_{DIW}$ (second flow channel) forming a transfer path of the ultra-pure water, a flow channel $\mathbf{10}_{CHM}$ forming a transfer path of the chemical, a flow channel $\mathbf{10}_{SLR}$ (first flow channel) forming a transfer path of the slurry, a flow channel $\mathbf{10}_{H2O2}$ forming a transfer path of the hydrogen peroxide water, and a blending flow channel 40 in which 4 types of liquids of ultra-pure water, a chemical, slurry, and hydrogen peroxide water are blended.

The blending flow channel 40 is arranged immediately before a liquid outlet 79 that reaches the CMP polishing device 8. The blending flow channel 40 communicates with the flow channel $\mathbf{20}_{DIW}$, the flow channel $\mathbf{10}_{CHM}$, the flow channel $\mathbf{10}_{SLR}$, and the flow channel $\mathbf{10}_{H2O2}$. The blending flow channel 40 is provided with mixing units $\mathbf{50}_{CHM}$, $\mathbf{50}_{SLR}$, and $\mathbf{50}_{H2O2}$, and flow rate sensors $\mathbf{61}_{CHM}$, $\mathbf{62}_{CHM}$, $\mathbf{63}_{CHM}$, $\mathbf{61}_{SLR}$, $\mathbf{62}_{SLR}$, $\mathbf{63}_{SLR}$, $\mathbf{61}_{H2O2}$, $\mathbf{62}_{H2O2}$, and $\mathbf{63}_{H2O2}$.

The flow channel $\mathbf{20}_{DIW}$ is provided with a low-pressure value 21 (precise regulator). The flow rate of the ultra-pure water in the flow channel $\mathbf{20}_{DIW}$ is kept constant (for example, 1 L/min) by the working of the low-pressure value 21. The end of the pipe forming the flow channel $\mathbf{20}_{DIW}$ is connected to the inflow port F1 of the mixing unit $\mathbf{50}_{CHM}$. The ultra-pure water transferred in the flow channel $\mathbf{20}_{DIW}$ flow into the mixing unit $\mathbf{50}_{CHM}$ from the inflow port F1.

The flow channel $\mathbf{10}_{CHM}$ is provided with a pump $\mathbf{11}_{CHM}$, a pressurizing tank 13*mm*, a filling amount sensor $\mathbf{16}_{CHM}$, a flow-controller $\mathbf{15}_{CHM}$, and a gas pressurizing part $\mathbf{14}_{CHM}$. The pump $\mathbf{11}_{CHM}$ is a rotary pump such as a diaphragm pump or a bellows pump. The pump $\mathbf{11}_{CHM}$ pumps out the chemical in the drum $\mathbf{12}_{CHM}$ and supplies the chemical to the side where the pressurizing tank $\mathbf{13}_{CHM}$ is located in the flow channel $\mathbf{10}_{CHM}$. The chemical pumped out by the pump $\mathbf{11}_{CHM}$ flows into the pressurizing tank $\mathbf{13}_{CHM}$ and is filled in the pressurizing tank $\mathbf{13}_{CHM}$. The liquid inflow port of the pressurizing tank $\mathbf{13}_{CHM}$ is provided with an open/close valve VLU and the liquid outflow port is provided with an open/close valve VLL, respectively. The open/close valves VLU and VLL of the pressurizing tank $\mathbf{13}_{CHM}$ open when an open signal $SV_{OP}$ is given, and close when a close signal $SV_{CL}$ is given.

The filling amount sensor $\mathbf{16}_{CHM}$ detects the filling amount of the chemical in the pressurizing tank $\mathbf{13}_{CHM}$ and outputs a signal indicating the detected filling amount. Specifically, when the filling amount of the chemical in the pressurizing tank $\mathbf{13}_{CHM}$ becomes less than a predetermined value, the filling amount sensor $\mathbf{16}_{CHM}$ outputs a detection signal $ST_{CHM}$ indicating that fact.

Under the control of the flow-controller $\mathbf{15}_{CHM}$, the gas pressurizing part $\mathbf{14}_{CHM}$ sends out nitrogen, which is an inert gas, from the gas inflow port at the upper portion of the pressurizing tank $\mathbf{13}_{CHM}$ into the pressurizing tank $\mathbf{13}_{CHM}$. The chemical in the pressurizing tank $\mathbf{13}_{CHM}$ is pushed out from the outflow port at the lower portion of the pressurizing tank $\mathbf{13}_{CHM}$ by the pressure of nitrogen.

The pipe of the flow channel $\mathbf{10}_{CHM}$ is connected to the inflow port F2 of the mixing unit $\mathbf{50}_{CHM}$. The chemical transferred in the flow channel $\mathbf{10}_{CHM}$ flows into the mixing unit $\mathbf{50}_{CHM}$ from the inflow port F2.

Figure 2:
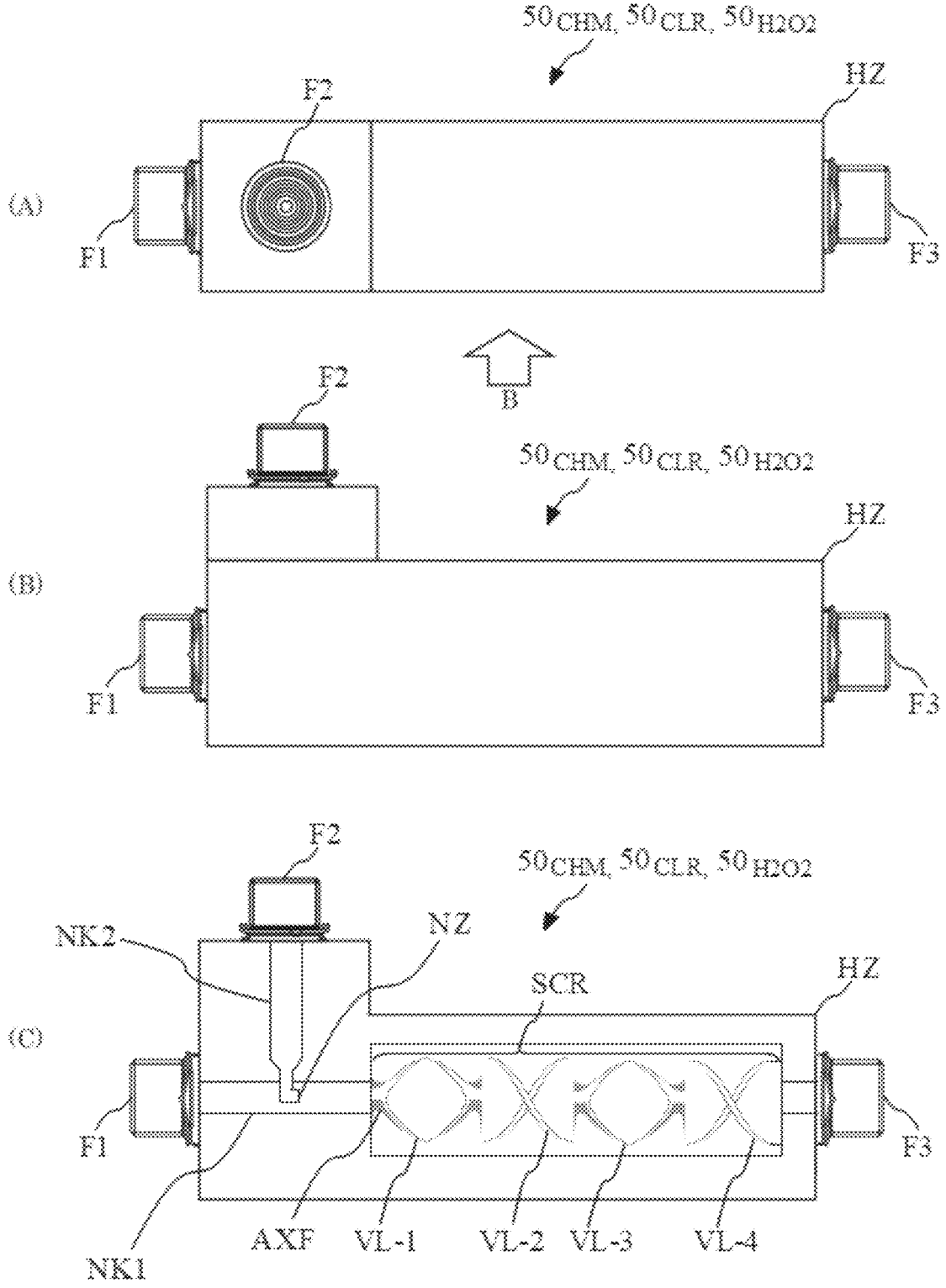
FIG. 2 is a diagram showing details of the configuration of the mixing unit in FIG. 1.

FIG. 2(A) is a front view of the mixing unit $\mathbf{50}_{CHM}$. FIG. 2(B) is a diagram of FIG. 2 (A) viewed from the direction of arrow B. FIG. 2(C) is a diagram showing the inside of FIG. 2(B). The mixing unit $\mathbf{50}_{CHM}$ has a housing HZ with two inflow ports F1 and F2 and one outflow port, and a stirring screw SCR accommodated in the housing HZ. The main body of the housing HZ is a hollow cylindrical body having a diameter substantially the same as or slightly thicker than the pipes of the flow channel $\mathbf{10}_{CHM}$ or the flow channel $\mathbf{20}_{DIW}$. There is an inflow port F1 at one end in the extending direction of the main body of the housing HZ, and an outflow port F3 at the other end. There is an inflow port F2 in the vicinity of the inflow port F1 on the side surface of the main body of the housing HZ. The inflow port F2 communicates with the inside of the main body of the housing HZ.

The inflow port F1 communicates with the pipe HK1 in the housing HZ. The tip end of the pipe HK1 is connected to the stirring screw SCR. The inflow port F2 communicates with the pipe HK2 in the housing HZ. There is a nozzle NZ at the tip end of the pipe HK2. The nozzle NZ is inserted into the pipe HK1 from the side surface of the pipe HK1. In the pipe HK1, the liquid discharge port of the nozzle NZ faces the stirring screw SCR.

The stirring screw SCR is a stirring screw in which N (N is a natural number of 2 or more, and in the example of FIG. 2, N=4) twist blades VL-k (k=1 to N) are arranged at intervals on a shaft rod AXS. The shaft rod AXS is supported in the inflow port F1 and the outflow port F3 of the housing HZ. The twist blades VL-k has a shape twisted half turn (180 degrees) along the outer peripheral surface of the shaft rod AXS. A plurality of twist blades VL-k (k=1 to N) are arranged with a phase shift of 90 degrees, and the twist blades VL-k that follow each other are perpendicular to each other with a shift of 90 degrees. The intervals between the twist blades VL-k that follow each other become equal. The intervals between the twist blades VL-k that follow each other become shorter than the size (the width in the front-rear direction) of the twist blades VL-k themselves.

Two types of liquids (ultra-pure water and chemical) that flow into the mixing unit $50_{CHM}$ from the inflow port F1 and the inflow port F2 of the mixing unit $50_{CHM}$ are mixed while being stirred in the mixing unit $50_{CHM}$, and a liquid obtained by blending the two types of liquids is sent out from the outflow port F3 of the mixing unit $50_{CHM}$.

The flow rate sensor $61_{CHM}$ detects the flow rate per unit time of the liquid (ultra-pure water) at a position immediately before the inflow port F1 of the mixing unit $50_{CHM}$ in the blending flow channel 40, and outputs a signal $SF1_{CHM}$ indicating the detected flow rate. The flow rate sensor $62_{CHM}$ detects the flow rate per unit time of the liquid (chemical) at a position immediately before the inflow port F2 of the mixing unit $50_{CHM}$ in the blending flow channel 40, and outputs a signal $SF2_{CHM}$ indicating the detected flow rate. The flow rate sensor $63_{CHM}$ detects the flow rate per unit time of a liquid (a liquid obtained by blending ultra-pure water and chemical) at a position immediately after the outflow port F3 of the mixing unit $50_{CHM}$ in the blending flow channel 40, and outputs a signal $SF3_{CHM}$ indicating the detected flow rate.

The flow channel $10_{SLR}$ becomes a circulation flow channel that returns to the drum $12_{SLR}$ from the flow channel $10_{SLR}$ through a branching point $17_{SLR}$ toward the blending flow channel 40. The flow channel $10_{SLR}$ is provided with a pump $11_{SLR}$, a pressurizing tank $13_{SLR}$, a filling amount sensor $16_{SLR}$, a flow-controller $15_{SLR}$, and a gas pressurizing part $14_{SLR}$. The pump $11_{SLR}$ pumps out the slurry in the drum $12_{SLR}$ and supplies the slurry to the side where the pressurizing tank $13_{SLR}$ is located in the flow channel $10_{SLR}$. The slurry pumped out by the pump $11_{SLR}$ flows into the pressurizing tank $13_{SLR}$ and is filled in the pressurizing tank $13_{SLR}$. The liquid inflow port at the upper portion of the pressurizing tank $13_{SLR}$ is provided with an open/close valve VLU and the liquid outflow port at the lower portion is provided with an open/close valve VLL, respectively. The open/close valves VLU and VLL of the pressurizing tank $13_{SLR}$ open when an open signal $SV_{OP}$ is given, and close when a close signal $SV_{CL}$ is given.

The filling amount sensor $16_{SLR}$ detects the filling amount of the slurry in the pressurizing tank $13_{SLR}$ and outputs a signal indicating the detected filling amount. Specifically, when the filling amount of the slurry in the pressurizing tank $13_{SLR}$ becomes less than a predetermined value, the filling amount sensor $16_{SLR}$ outputs a detection signal $ST_{SLR}$ indicating that fact.

Under the control of the flow-controller $15_{SLR}$, the gas pressurizing part $14_{SLR}$ sends out nitrogen, which is an inert gas, from the gas inflow port at the upper portion of the pressurizing tank $13_{SLR}$ into the pressurizing tank $13_{SLR}$. The slurry in the pressurizing tank $13_{SLR}$ is pushed out from the outflow port at the lower portion of the pressurizing tank $13_{SLR}$ by the pressure of nitrogen.

The end portion branched from the branching point $17_{SLR}$ in the pipe of the flow channel $10_{SLR}$ is connected to the inflow port F2 of the mixing unit $50_{SLR}$. The slurry transferred in the flow channel $10_{SLR}$ is branched at the branching point $17_{SLR}$ and then flows into the mixing unit $50_{SLR}$ from the inflow port F2. The remaining slurry that has not advanced to the side of the mixing unit $50_{SLR}$ returns to the drum $12_{SLR}$ through the pipe between the branching point $17_{SLR}$ and the drum $12_{SLR}$.

The two types of liquids (ultra-pure water including chemical, and slurry) flowing into the mixing unit $50_{SLR}$ from the inflow ports F1 and F2 of the mixing unit $50_{SLR}$ are mixed while being stirred by passing through the stirring screw SCR in the mixing unit $50_{SLR}$, and the liquid obtained by blending the chemical, the ultra-pure water, and the slurry is sent out from the outflow port F3 of the mixing unit $50_{SLR}$.

The structure of the mixing unit $50_{SLR}$ is the same as that of the mixing unit $50_{CHM}$. As shown in FIG. 2(A), FIG. 2(B), and FIG. 2(C), the mixing unit $50_{SLR}$ has a housing HZ with two inflow ports F1 and F2 and one outflow port F3, and a stirring screw SCR accommodated in the housing HZ.

Figure 3:
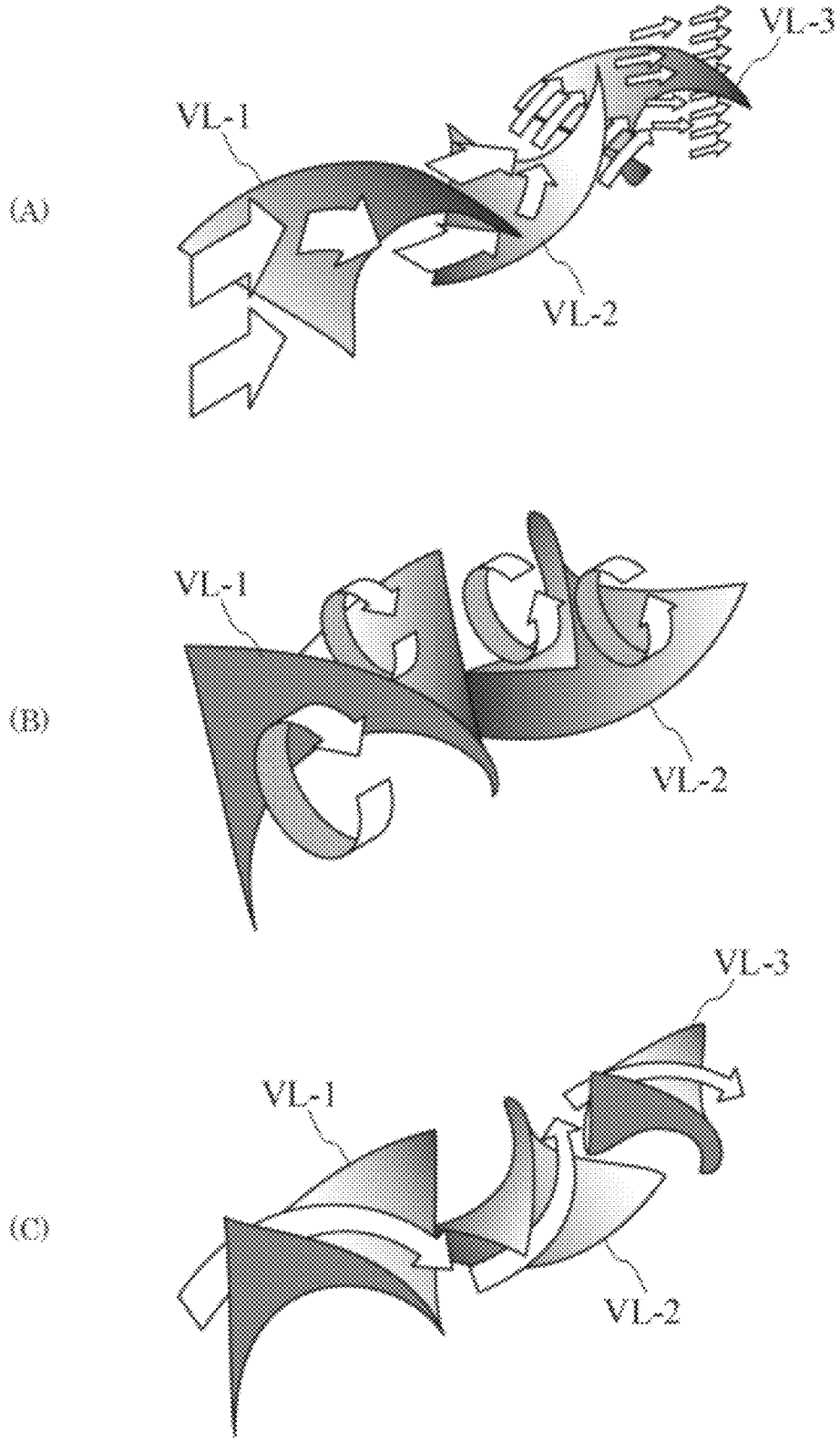
FIG. 3 is a diagram for explaining an action related to stirring and blending of the mixing unit in FIG. 1.

Here, the liquid (ultra-pure water including chemical) flowing into the mixing unit $50_{SLR}$ from the inflow port F1 and the liquid (slurry) flowing into the mixing unit $50_{SLR}$ from the inflow port F2 merge at a position where the nozzle NZ protrudes in the pipe HK1. After this merging, the two types of liquids pass through the twist blade VL-1→twist blade VL-2→twist blade VL-3→twist blade VL-4 successively. As shown in FIG. 3(A), each time they pass through one twist blade VL-k, the two types of liquids are approximately equally divided into one twist surface side of the twist blade VL-k and the other twist surface side on the back side thereof. Further, as shown in FIG. 3(B), the two types of liquids recirculate from the shaft rod AXS side to the inner wall surface side or from the inner wall surface side to the shaft rod AXS side on the twist surface of the twist blade VL-k. Furthermore, as shown in FIG. 3(C), between the two twist blades VL-k that follow each other, the rotation direction of the two types liquids are reversed. A liquid formed by diluting the slurry at a uniform concentration is obtained by the three actions of the dividing action, the recirculating action and the reversing action.

In FIG. 1, the flow rate sensor $61_{SLR}$ detects the flow rate per unit time of the liquid (ultra-pure water including chemical) at a position immediately before the inflow port F1 of the mixing unit $50_{SLR}$ in the blending flow channel 40, and outputs a signal $SF1_{SLR}$ indicating the detected flow rate. The flow rate sensor $62_{SLR}$ detects the flow rate per unit time of the liquid (slurry) at a position immediately before the inflow port F2 of the mixing unit $50_{SLR}$ in the blending flow channel 40, and outputs a signal $SF2_{SLR}$ indicating the detected flow rate. The flow rate sensor $63_{SLR}$ detects the flow rate per unit time of a liquid (a liquid obtained by blending ultra-pure water, a chemical, and slurry) at a position immediately after the outflow port F3 of the mixing unit $50_{SLR}$ in the blending flow channel 40, and outputs a signal $SF3_{SLR}$ indicating the detected flow rate.

The flow channel $10_{H2O2}$ is provided with a pump $11_{H2O2}$, a pressurizing tank $13_{H2O2}$, a filling amount sensor $16_{H2O2}$, a flow-controller $15_{H2O2}$, and a gas pressurizing part $14_{H2O2}$. The pump $11_{H2O2}$ pumps out the hydrogen peroxide water in the drum $12_{H2O2}$ and supplies the hydrogen peroxide water to the side where the pressurizing tank $13_{H2O2}$ is located in the flow channel $10_{H2O2}$. The hydrogen peroxide water pumped out by the pump $11_{H2O2}$ flows into the pressurizing tank $13_{H2O2}$ and is filled in the pressurizing tank $13_{H2O2}$. The liquid inflow port at the upper portion of the pressurizing tank $13_{H2O2}$ is provided with an open/close valve VLU and the liquid outflow port at the lower portion is provided with an open/close valve VLL, respectively. The open/close valves VLU and VLL of the pressurizing tank $13_{H2O2}$ open when an open signal $SV_{OP}$ is given, and close when a close signal $SV_{CL}$ is given.

The filling amount sensor $16_{H2O2}$ detects the filling amount of the hydrogen peroxide water in the pressurizing tank $13_{H2O2}$ and outputs a signal indicating the detected filling amount. Specifically, when the filling amount of the hydrogen peroxide water in the pressurizing tank $13_{H2O2}$ becomes less than a predetermined value, the filling amount sensor $16_{H2O2}$ outputs a detection signal $ST_{H2O2}$ indicating that fact.

Under the control of the flow-controller $15_{H2O2}$, the gas pressurizing part $14_{H2O2}$ sends out nitrogen, which is an inert gas, from the gas inflow port at the upper portion of the pressurizing tank $13_{H2O2}$ into the pressurizing tank $13_{H2O2}$. The hydrogen peroxide water in the pressurizing tank $13_{H2O2}$ is pushed out from the outflow port at the lower portion of the pressurizing tank $13_{H2O2}$ by the pressure of nitrogen.

The pipe of the flow channel $10_{H2O2}$ is connected to the inflow port F2 of the mixing unit $50_{H2O2}$. The hydrogen peroxide water transferred in the flow channel $10_{H2O2}$ flows into the mixing unit $50_{H2O2}$ from the inflow port F2. The structure of the mixing unit $50_{H2O2}$ is the same as the structure of the mixing unit $50_{CHM}$.

Two types of liquids that flow into the mixing unit $50_{H2O2}$ from the inflow port F1 and the inflow port F2 of the mixing unit $50_{H2O2}$ are mixed while being stirred in the mixing unit $50_{H2O2}$, and a liquid obtained by blending the two types of liquids is sent out from the outflow port F3 of the mixing unit $50_{H2O2}$.

The flow rate sensor $61_{H2O2}$ detects the flow rate per unit time of a liquid (a liquid obtained by blending ultra-pure water, a chemical, and a slurry) at a position immediately before the inflow port F1 of the mixing unit $50_{H2O2}$ in the blending flow channel 40, and outputs a signal $SF1_{H2O2}$ indicating the detected flow rate. The flow rate sensor $62_{H2O2}$ detects the flow rate per unit time of the liquid (hydrogen peroxide water) at a position immediately before the inflow port F2 of the mixing unit $50_{H2O2}$ in the blending flow channel 40, and outputs a signal $SF2_{H2O2}$ indicating the detected flow rate. The flow rate sensor $63_{H2O2}$ detects the flow rate per unit time of the liquid (a liquid obtained by blending ultra-pure water, a chemical, slurry, and hydrogen peroxide water) at a position immediately after the outflow port F3 of the mixing unit $50_{H2O2}$ in the blending flow channel 40, and outputs a signal $SF3_{H2O2}$ indicating the detected flow rate.

The PLC70 is a device that serves as control means of the polishing liquid supply device 2. The PLC70 performs a first control, a second control and a third control. In the first control, the operation of the flow-controllers $15_{CHM}$, $15_{SLR}$, and $15_{H2O2}$ is controlled to adjust the gas pressure of the gas pressurizing parts $14_{CHM}$, $14_{SLR}$, and $14_{H2O2}$, so that a magnitude relation among a liquid pressure Pa of the inflow port F1 of the mixing unit $50_{CHM}$, a liquid pressure Pb of the inflow port F2 of the mixing unit $50_{CHM}$, a liquid pressure Pc of the inflow port F1 of the mixing unit $50_{SLR}$, a liquid pressure Pd of the inflow port F2 of the mixing unit $50_{SLR}$, a liquid pressure Pe of the inflow port F1 of the mixing unit $50_{H2O2}$, and a liquid pressure Pf of the inflow port F2 of the mixing unit $50_{H2O2}$ is Pa<Pb<Pc<Pd<Pe<Pf. In the second control, based on the relationship between the flow rate of the liquid in the blending flow channel 40 and the target value of dilution, the flow-controllers $14_{CHM}$, $15_{SLR}$, and $15_{H2O2}$ are controlled to adjust the nitrogen pressure of the gas pressurizing parts $14_{CHM}$, $14_{SLR}$, and $14_{H2O2}$. In the third control, the pressurizing tank 13 that communicates with the blending flow channel 40 is switched.

More specifically, the PLC70 monitors the pressures Pa, Pb, Pc, Pd, Pe, Pd, and Pf from the output signals $SF1_{CHM}$, $SF1_{SLR}$, and $SF1_{H2O2}$ of the flow rate sensors $61_{CHM}$, $61_{SLR}$, and $61_{H2O2}$, and the output signals $SF2_{CHM}$, $SF2_{SLR}$, and $SF2_{H2O2}$ of the flow rate sensors $62_{CHM}$, $62_{SLR}$, and $62_{H2O2}$. The PLC70 supplies a signal SG instructing the flow-controller $15_{CHM}$ to increase the nitrogen pressure when Pa≥Pb. The PLC70 supplies a signal SG instructing the flow-controller $61_{SLR}$ to increase the nitrogen pressure when Pc≥Pd. The PLC70 supplies a signal SG instructing the flow-controller $15_{H2O2}$ to increase the nitrogen pressure when Pe≥Pf.

The PLC70 sets a value obtained by dividing the output signal $SF2_{SLR}$ of the flow rate sensor $62_{SLR}$ by the output signal $SF1_{SLR}$ of the flow rate sensor $61_{SLR}$ as the current dilution of the slurry, and when the dilution of the slurry is lower than the target value of the dilution, it supplies the signal SG instructing the flow-controller $15_{SLR}$ to increase the nitrogen pressure. The flow-controller $15_{SLR}$ controls the gas pressurizing part $14_{SLR}$ according to the given signal SG; and adjusts the flow rate of the liquid in the flow channel $10_{SLR}$.

The PLC 70 monitors whether or not the signals $ST_{CHM}$, $ST_{SLR}$, and $ST_{H2O2}$ in the filling amount sensors $16_{CHM}$, $16_{SLR}$, and $16_{H2O2}$ are output. For the four pressurizing tanks $13_{CHM}$, the PLC70 recursively repeats control of closing the open/close valves VLU and VLL of the pressurizing tank $13_{CHM}$ in which the filling amount becomes less than a predetermined amount, and opening the open/close valves VLU and VLL of other pressurizing tanks $13_{CHM}$. The PLC70 repeats the same control for the pressurizing tanks $13_{SLR}$, and $13_{H2O2}$.

The above is the details of the configuration of the present embodiment. According to the present embodiment, the following effects can be obtained.

First, in the present embodiment, there is a blending flow channel 40 communicating with the flow channel in which ultra-pure water, a chemical, slurry, and hydrogen peroxide water are transferred. In this blending flow channel 40, a plurality of types of liquids are blended, and the blended liquid is supplied to the CMP polishing device 8 as a polishing liquid. For this reason, in the present embodiment, it is not necessary to provide a blending tank that blends a plurality of types of liquids. Therefore, the liquid does not stay in the blending tank and aggregation/precipitation does not occur, and a polishing liquid with a uniform concentration can be stably supplied to the CMP polishing device 8.

Second, in the present embodiment, since there is no blending tank, it is not necessary to provide a drying prevention mechanism and a solidification prevention mechanism in the blending tank. Accordingly, since it is not necessary to replace consumption articles that play a part of the drying prevention mechanism and the solidification prevention mechanism, the number of maintenance processes of the polishing liquid supply device 2 can be greatly reduced.

Third, in the embodiment, the blending flow channel 40 is arranged immediately before a liquid outlet 79 that reaches the CMP polishing device 8. For this reason, after a polishing liquid is obtained by blending a plurality of types of liquids, the polishing liquid can be used for polishing a wafer 88 by the CMP polishing device 8 in a fresh state. Therefore, chemical attack is less likely to occur, and coarse particles that cause scratches can be reduced. In addition, the polishing liquid does not change with time from blending to use. Thereby, a stable polishing property can be obtained.

Fourth, in the present embodiment, the blending flow channel 40 is provided with mixing units $\mathbf{50}_{CHM}$, $\mathbf{50}_{SLR}$, and $\mathbf{50}_{H2O2}$, and the mixing units $\mathbf{50}_{CHM}$, $\mathbf{50}_{SLR}$, and $\mathbf{50}_{H2O2}$ are provided with stirring screws SCR. The liquid flowed in from the inflow port is mixed while being stirred by passing through the stirring screw SCR. Therefore, the time required for stirring can be greatly reduced as compared with the conventional method in which the liquid is stored in the blending tank and stirred by the stirring device. Further, the mixing units $\mathbf{50}_{CHM}$, $\mathbf{50}_{SLR}$, and $\mathbf{50}_{H2O2}$ are less bulky than the blending tank, and the configuration itself of the mixing units $\mathbf{50}_{CHM}$, $\mathbf{50}_{SLR}$, and $\mathbf{50}_{H2O2}$ is simpler than that of the blending tank. Therefore, the device design of the CMP system 1 is simplified and the delivery time of the system can be shortened.

Fifth, in the present embodiment, the blending flow channel 40 is provided with flow rate sensors $\mathbf{61}_{CHM}$, $\mathbf{62}_{CHM}$, $\mathbf{63}_{CHM}$, $\mathbf{61}_{SLR}$, $\mathbf{62}_{SLR}$, $\mathbf{63}_{SLR}$, $\mathbf{61}_{H2O2}$, $\mathbf{62}_{H2O2}$, and $\mathbf{63}_{H2O2}$ that detect the liquid flow rate per unit time in the blending flow channel 40 and output signals $SF\mathbf{1}_{CHM}$, $SF\mathbf{1}_{SLR}$, $SF\mathbf{1}_{H2O2}$, $SF\mathbf{2}_{CHM}$, $SF\mathbf{2}_{SLR}$, and $SF\mathbf{2}_{H2O2}$ indicating the detected flow rate, and the flow channels in which a chemical, slurry, and hydrogen peroxide water are transferred are provided with flow-controllers $\mathbf{15}_{CHM}$, $\mathbf{15}_{SLR}$, and $\mathbf{15}_{H2O2}$ adjusting the flow rate of the liquid in the flow channel according to the given signals SG Then, the PLC70, which is the control means, controls the operations of the flow-controllers $\mathbf{15}_{CHM}$, $\mathbf{15}_{SLR}$, and $\mathbf{15}_{H2O2}$ based on the relationship between the liquid flow rate in the blending flow channel 40 and the target value. Therefore, the slurry concentration can be adjusted efficiently by setting the flow rate target value with the operation element. Further, it is also possible to flexibly deal with circumstantial changes such as a change in the dilution ratio of the polishing liquid, a change in the wafer 88, a change in the polishing removal amount on the CMP polishing device 8 side.

Sixth, in the present embodiment, the number of the pressurizing tanks $\mathbf{13}_{CHM}$, $\mathbf{13}_{SLR}$, and $\mathbf{13}_{H2O2}$ is plural (four each in the example of the present embodiment), and the PLC70 as the control means recursively repeats the control of closing the open/close valves VLU and VLL of the pressurizing tanks $\mathbf{13}_{CHM}$, $\mathbf{13}_{SLR}$, and $\mathbf{13}_{H2O2}$ in which the filling amount becomes less than a predetermined amount, and opening the open/close valves VLU and VLL of other pressurizing tanks $\mathbf{13}_{CHM}$, $\mathbf{13}_{SLR}$, and $\mathbf{13}_{H2O2}$. Therefore, according to the present embodiment, it is possible to reliably prevent the occurrence of a situation where the liquid in the pressurizing tanks $\mathbf{13}_{CHM}$, $\mathbf{13}_{SLR}$, and $\mathbf{13}_{H2O2}$ is exhausted and the supply of the liquid to the mixing units $\mathbf{50}_{CHM}$, $\mathbf{50}_{SLR}$, and $\mathbf{50}_{H2O2}$ comes to an end.

Second Embodiment

Figure 4:
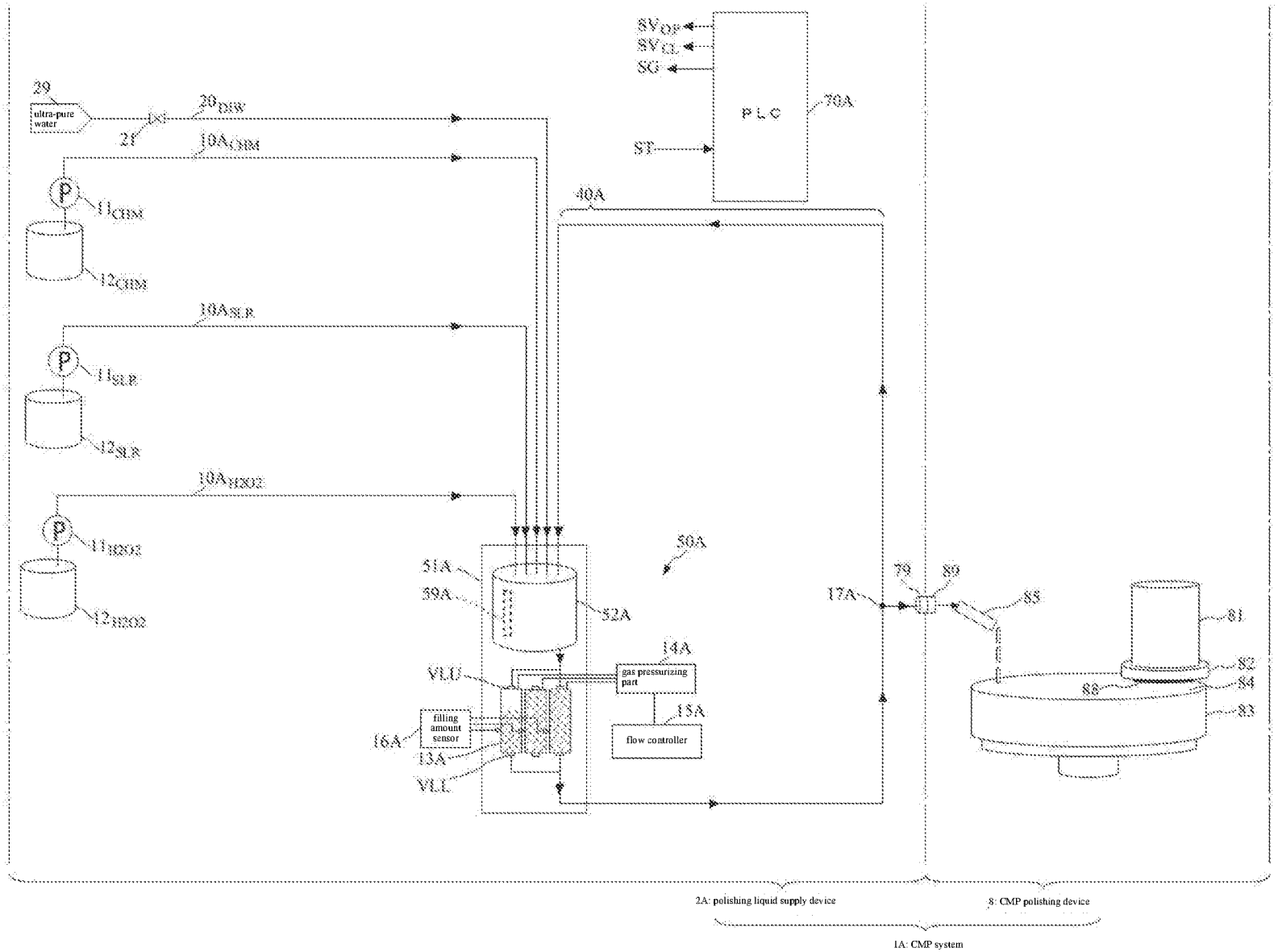
FIG. 4 is a diagram showing an overall structure of a CMP system including a polishing liquid supply device of the second embodiment of the present disclosure.

FIG. 4 is a diagram showing an overall structure of a CMP system 1 including a polishing liquid supply device 2 of the second embodiment of the present disclosure. In FIG. 4, the same reference numerals are given to the same elements as those of the polishing liquid supply device 2 of the above first embodiment. The mixing units $\mathbf{50}_{CHM}$, $\mathbf{50}_{SLR}$, and $\mathbf{50}_{H2O2}$ of the polishing liquid supply device 2 of the above first embodiment are formed in a structure having a cylindrical body with a diameter that is substantially the same as or slightly larger than that of the flow channel, and a plurality of liquids were blended in-line in the mixing units $\mathbf{50}_{CHM}$, $\mathbf{50}_{SLR}$, and $\mathbf{50}_{H2O2}$. On the other hand, the mixing unit 50A of the polishing liquid supply device 2 of the present embodiment is configured to have a blending tank 52A and a stirring device 59A, and a plurality of liquids are stirred and blended in the tank 52A.

The polishing liquid supply device 2 of the CMP system 1 has a PLC70A, an ultra-pure water inlet 29 connected to an external ultra-pure water supply source, a drum $\mathbf{12}_{CHM}$ storing a chemical, a drum $\mathbf{12}_{SLR}$ storing slurry, a drum $\mathbf{12}_{H2O2}$ storing hydrogen peroxide water, a flow channel $\mathbf{20}_{DIW}$ (second flow channel) forming a transfer path of the ultra-pure water, a flow channel $\mathbf{10}A_{CHM}$ forming a transfer path of the chemical, a flow channel $\mathbf{10}A_{SLR}$ (first flow channel) forming a transfer path of the slurry, a flow channel $\mathbf{10}A_{H2O2}$ forming a transfer path of the hydrogen peroxide water, a mixing unit 50A connected to the pipes of these flow channels $\mathbf{10}A_{CHM}$, $\mathbf{10}A_{SLR}$, and $\mathbf{10}A_{H2O2}$, and a flow channel 40A from the mixing unit 50A to the CMP polishing device 8.

The flow channel $\mathbf{10}A_{CHM}$ is provided with a pump $\mathbf{11}_{CHM}$. The pump $\mathbf{11}_{CHM}$ pumps out the chemical in the drum $\mathbf{12}_{CHM}$ and supplies the chemical to the side where the mixing unit 50A is located in the flow channel $\mathbf{10}A_{CHM}$. The flow channel $A\mathbf{10}_{SLR}$ is provided with a pump $\mathbf{11}_{SLR}$. The pump $\mathbf{11}_{SLR}$ pumps out the slurry in the drum $\mathbf{12}_{SLR}$ and supplies the slurry to the side where the mixing unit 50A is located in the flow channel $\mathbf{10}A_{SLR}$. The flow channel $\mathbf{10}A_{H2O2}$ is provided with a pump $\mathbf{11}_{H2O2}$. The pump $\mathbf{11}_{H2O2}$ pumps out the hydrogen peroxide water in the drum $\mathbf{12}_{H2O2}$ and supplies the hydrogen peroxide water to the side where the mixing unit 50A is located in the flow channel $\mathbf{10}A_{H2O2}$.

The flow channel 40A is a circulation flow channel that returns to the blending tank 52A of the mixing unit 50A through a branching point 17A toward the CMP polishing device 8.

The mixing unit 50A obtains the polishing liquid used in the polishing of the CMP polishing device 8 by blending four types of liquids of a chemical, ultra-pure water, slurry, and hydrogen peroxide water. The mixing unit 50A has a case body 51A, a blending tank 52A, a stirring device 59A, a pressurizing tank 13A, a filling amount sensor 16A, a flow-controller 15A, and a gas pressurizing part 14A.

The case body 51A has a hollow rectangular parallelopiped shape. There is a blending tank 52A in the upper portion in the case body 51A, and a plurality of (three in the example of FIG. 2) pressurizing tanks 13A in the lower portion in the case body 51A.

The blending tank 52A has a hollow cylindrical shape. The ultra-pure water transferred in the flow channel $\mathbf{20}_{DIW}$, the chemical transferred in the flow channel $\mathbf{10}A_{CHM}$, the slurry transferred in the flow channel $\mathbf{10}A_{SLR}$, and the hydrogen peroxide water transferred in the flow channel $\mathbf{10}A_{H2O2}$ flow into the blending tank 52A. The stirring device 59A stirs and mixes the four types of liquids that have flowed into the blending tank 52A.

There is a pipe extending downward at the bottom of the blending tank 52A. This pipe is branched into a plurality of pipes, and the branched pipes are connected to the inflow ports of the plurality of pressurizing tanks 13A. The pressurizing tank 13A has a cylindrical shape. The pressurizing tank 13A is arranged at a position directly below the blending tank 52A in the case body 51A so that the inflow port is directed upward and the outflow port is directed downward.

In the blending tank 52A, the polishing liquid obtained by stirring the four types of liquids flow to the pressurizing tank 13A through the lower pipe by its own weight, and filled in the pressurizing tank 13A. The liquid inflow port of the pressurizing tank 13A is provided with an open/close valve VLU and the liquid outflow port is provided with an open/close valve VLL, respectively. The open/close valves VLU and VLL of the pressurizing tank 13A open when an open signal $SV_{OP}$ is given, and close when a close signal $SV_{CL}$ is given.

The filling amount sensor 16A detects the filling amount of the liquid in the pressurizing tank 13A and outputs a signal indicating the detected filling amount. Specifically, when the filling amount of the liquid in the pressurizing tank 13A becomes less than a predetermined value, the filling amount sensor 16A outputs a detection signal ST indicating that fact.

Under the control of the flow-controller 15A, the gas pressurizing part 14A sends out nitrogen, which is an inert gas, from the gas inflow port at the upper portion of the pressurizing tank 13A into the pressurizing tank 13A. The liquid in the pressurizing tank 13A is pushed out from the outflow port at the lower portion of the pressurizing tank 13A by the pressure of nitrogen.

The PLC70A is a device that serves as control means of the polishing liquid supply device 2. The PLC70A performs control of switching the pressurizing tank 13A that communicates with the blending flow channel 40.

More specifically, whether there is a signal ST in the filling amount sensor 16A is monitored. For the three pressurizing tanks 13A, the PLC70A recursively repeats control of closing the open/close valves VLU and VLL of the pressurizing tank 13A in which the filling amount becomes less than a predetermined amount, and opening the open/close valves VLU and VLL of other pressurizing tanks 13A.

The above is the details of the configuration of the present embodiment. According to the present embodiment, the following effects can be obtained.

First, in the present embodiment, the polishing liquid obtained by blending the liquids in the blending tank 52A of the mixing unit 50A is filled in the pressurizing tank 13A, and the gas pressurizing part 14A sends out an inert gas into the pressurizing tank 13A to push out the polishing liquid in the pressurizing tank 13A to the CMP polishing device 8. Therefore, it is possible to stably supply an ultrahigh precise polishing liquid to the CMP polishing device 8.

Second, in the present embodiment, a blending tank 52A storing the polishing liquid obtained by blending the liquids is included. A flow channel reaching the CMP polishing device 8 is a circulation flow channel that returns to the blending tank 52A via a branching point 17A from the blending tank 52A toward the CMP polishing device 8. Therefore, the liquid does not stay in the blending tank 52A and aggregation/precipitation does not occur, and a polishing liquid with a uniform concentration can be stably supplied to the CMP polishing device 8.

Third, in the present embodiment, the pressurizing tank 13A is arranged below the blending tank 52A so that the liquid in the blending tank 52A flows from the blending tank 52A into the pressurizing tank 13A by its weight. Therefore, it is not necessary to provide a special device such as a pump in the blending tank 52A, and the liquid can be transferred from the blending tank 52A to the pressurizing tank 13A without risk of oxidation of the polishing liquid or change in the components.

Fourth, in the present embodiment, the pressurizing tank 13A has a cylindrical shape. The pressurizing tank 13A is arranged so that the inflow port of the liquid from the blending tank 52A to the pressurizing tank 13A is on the upper side, and the outflow port of the liquid from the pressurizing tank 13A to the CMP polishing device 8 is on the lower side. Therefore, the liquid flow of the blending tank 52A→the pressurizing tank 13A→the CMP polishing device 8 can be made even smoother.

Fifth, in the present embodiment, the number of pressurizing tanks 13A is plural. The PLC 70 as the control means recursively repeats control of closing the open/close valves VLU and VLL of the pressurizing tank 13A in which the filling amount becomes less than a predetermined amount and opening the open/close valves VLU and VLL of the other pressurizing tanks 13A. Therefore, according to the present embodiment, it is possible to reliably prevent the occurrence of a situation where the liquid in the pressurizing tank 13A is exhausted and the supply of the liquid to the CMP polishing device 8 comes to an end.

MODIFIED EXAMPLE

Although the first and second embodiments of the present disclosure have been described above, the following modifications may be added to these embodiments.

(1) The above first embodiment has been formed in a manner where the flow rate sensors $\mathbf{61}_{CHM}$, $\mathbf{61}_{SLR}$, $\mathbf{61}_{H2O2}$, $\mathbf{62}_{CHM}$, $\mathbf{62}_{SLR}$, and $\mathbf{62}_{H2O2}$ detect the flow rate per unit time of the liquid in the blending flow channel 40, and the flow-controllers $\mathbf{15}_{CHM}$, $\mathbf{15}_{SLR}$, and $\mathbf{15}_{H2O2}$ adjust the flow rate of the liquid in the flow channels $\mathbf{10}_{CHM}$, $\mathbf{10}_{SLR}$, $\mathbf{10}_{H2O2}$ according to the given signal. However, it may be formed in a manner where the flow rate sensors $\mathbf{61}_{CHM}$, $\mathbf{61}_{SLR}$, $\mathbf{61}_{H2O2}$, $\mathbf{62}_{CHM}$, $\mathbf{62}_{SLR}$, and 6214202 detect the pressure of the liquid in the blending flow channel 40, and the flow-controllers $\mathbf{15}_{CHM}$, $\mathbf{15}_{SLR}$, and $\mathbf{15}_{H2O2}$ adjust the pressure of the liquid in the flow channels $\mathbf{10}_{CHM}$, $\mathbf{10}_{SLR}$, $\mathbf{10}_{H2O2}$ according to the given signal.

(2) The order of blending the plurality of types of liquids in the blending flow channel 40 of the above first embodiment is not limited to that of the first embodiment. For example, the order may be such that the slurry and the chemical are first blended, the hydrogen peroxide water is then blended, and the ultra-pure water is finally blended and diluted.

(3) The number of each of the pressurizing tanks $\mathbf{13}_{CHM}$, $\mathbf{13}_{SLR}$, and $\mathbf{13}_{H2O2}$ in the above first embodiment may be 2 to 3, or may be 5 or more. Further, the number of the pressurizing tanks 13A in the above second embodiment may be 2, or may be 4 or more.

(4) The above first embodiment has been formed in a manner where nitrogen is sent to the pressurizing tanks $\mathbf{13}_{CHM}$, $\mathbf{13}_{SLR}$, and $\mathbf{13}_{H2O2}$, and the liquid in the pressurizing tanks $\mathbf{13}_{CHM}$, $\mathbf{13}_{SLR}$, and $\mathbf{13}_{H2O2}$ is pushed out from the pressurizing tanks $\mathbf{13}_{CHM}$, $\mathbf{13}_{SLR}$, and $\mathbf{13}_{H2O2}$ by the pressure of the nitrogen. However, another inert gas (for example, argon) may be sent to the pressurizing tanks $\mathbf{13}_{CHM}$, $\mathbf{13}_{SLR}$, and $\mathbf{13}_{H2O2}$.

(5) The second embodiment has been formed in a manner where nitrogen is sent to the pressurizing tanks 13A, and the liquid in the pressurizing tank 13A is pushed out from the pressurizing tank 13A by the pressure of the nitrogen. However, another inert gas (for example, argon) may be sent to the pressurizing tank 13A.

(6) In the above first embodiment, it is not necessary to provide an open/close valve in both the inflow port and the outflow port of the pressurizing tanks $\mathbf{13}_{CHM}$, $\mathbf{13}_{SLR}$, and $\mathbf{13}_{H2O2}$. It is sufficient that an open/close valve is provided in at least one of the inflow port and the outflow port of the pressurizing tanks $\mathbf{13}_{CHM}$, $\mathbf{13}_{SLR}$, and $\mathbf{13}_{H2O2}$, and the PLC70 as the control means may recursively repeat the control of opening/closing the open/close valve.

(6) In the above second embodiment, it is not necessary to provide an open/close valve in both the inflow port and the outflow port of the pressurizing tanks 13A. It is sufficient that an open/close valve is provided in at least one of the inflow port and the outflow port of the pressurizing tank 13A, and the PLC70 as the control means may recursively repeat the control of opening/closing the open/close valve.

Figure 5:
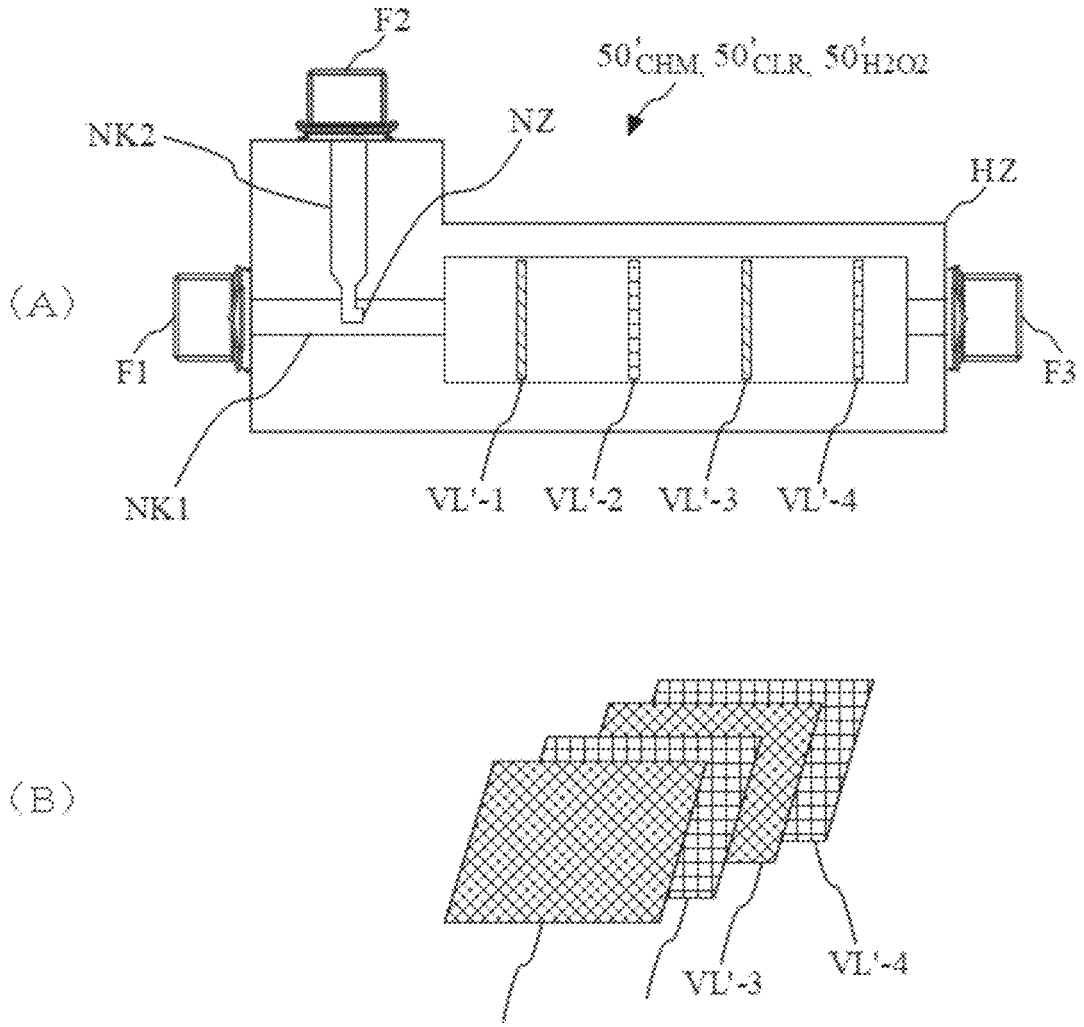
FIG. 5 is a diagram showing details of the configuration of a mixing unit of a modified example of the present disclosure.

(8) In the above first embodiment, the mixing units $\mathbf{50}_{CHM}$, $\mathbf{50}_{SLR}$, and $\mathbf{50}_{H2O2}$ were mixing units having a stirring screw SCR accommodated in a cylindrical body, and the stirring screw SCR was a stirring screw having N twist blades VL-k (k=1 to N) arranged at intervals on a shaft rod AXS. However, as the mixing units $\mathbf{50'}_{CHM}$, $\mathbf{50'}_{CSLR}$, and $\mathbf{50'}_{H2O2}$ shown in FIG. 5(A) and FIG. 5(B), the stirring screw SCR may be replaced with a mixer in which N (N is a natural number of 2 or more, and in the example of FIG. 5, N=4) meshes VL'-k (k=1 to N) are arranged side by side in the hollow cylindrical body extending between the inflow port F1 and the outflow port F3 so that mesh orientation of meshes that follow each other is shifted by a predetermined angle (45 degrees in the example of FIG. 5(B)).

Figure 6:
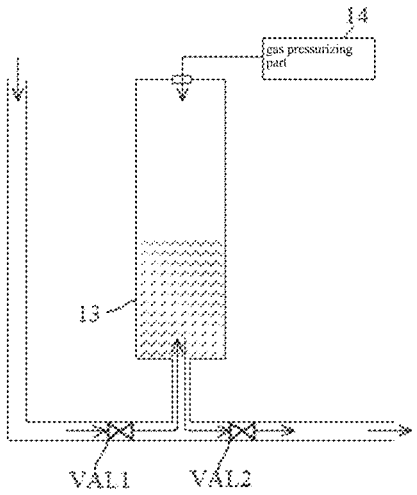
FIG. 6 is a diagram showing details of configuration of a pressurizing tank of the polishing liquid supply device of the modified example of the present disclosure.

(9) In the above first and second embodiments, there are liquid inflow ports at the upper portions of the pressurizing tanks $\mathbf{13}_{CHM}$, $\mathbf{13}_{SLR}$, $\mathbf{13}_{H2O2}$, and 13A, and there are liquid outflow ports at the lower portions of the pressurizing tanks $\mathbf{13}_{CHM}$, $\mathbf{13}_{SLR}$, $\mathbf{13}_{H2O2}$, and 13A. However, both the liquid inflow ports and the liquid outflow ports may be provided at the lower portions of the pressurizing tanks $\mathbf{13}_{CHM}$, $\mathbf{13}_{SLR}$, $\mathbf{13}_{H2O2}$, and 13A. For example, as shown in FIG. 6, a pipe is provided at the lower portion (bottom portion) of $\mathbf{13}_{CHM}$, $\mathbf{13}_{SLR}$, $\mathbf{13}_{H2O2}$, and 13A, and the lower portion of this pipe is branched into a T-shape on the liquid inflow side and the liquid outflow side. A first valve VAL1 may be provided in the pipe on the inflow side and a second valve VAL2 may be provided in the pipe on the outflow side. Then, the PLC may recursively repeat the control of opening the first valve VAL1 and closing the second valve VAL1 to fill the liquid in the pressurizing tanks $\mathbf{13}_{CHM}$, $\mathbf{13}_{SLR}$, $\mathbf{13}_{H2O2}$, and 13A until the filling amount of the liquid in the pressurizing tanks $\mathbf{13}_{CHM}$, $\mathbf{13}_{SLR}$, $\mathbf{13}_{H2O2}$, and 13A reaches a predetermined amount (for example, 90%), and closing the first valve VAL1 and opening the second valve VAL1 to push out the liquid in the pressurizing tanks $\mathbf{13}_{CHM}$, $\mathbf{13}_{SLR}$, $\mathbf{13}_{H2O2}$, and 13A by the pressure of nitrogen when the filling amount of the liquid in the pressurizing tanks $\mathbf{13}_{CHM}$, $\mathbf{13}_{SLR}$, $\mathbf{13}_{H2O2}$, and 13A has reached a predetermined amount.

Figure 7:
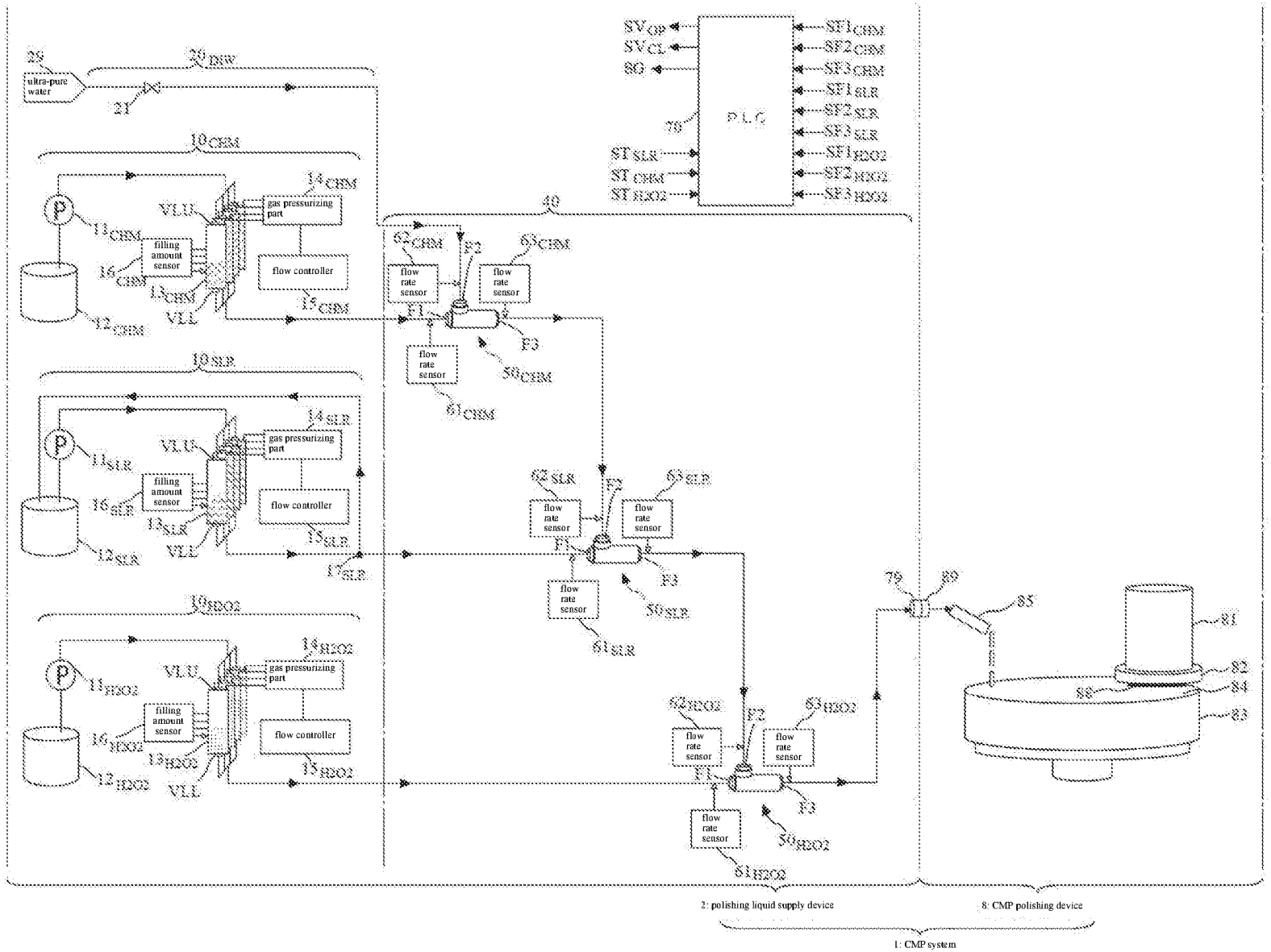
FIG. 7 is a diagram showing an overall structure of a CMP system including a polishing liquid supply device of the modified example of the present disclosure.
Figure 8:
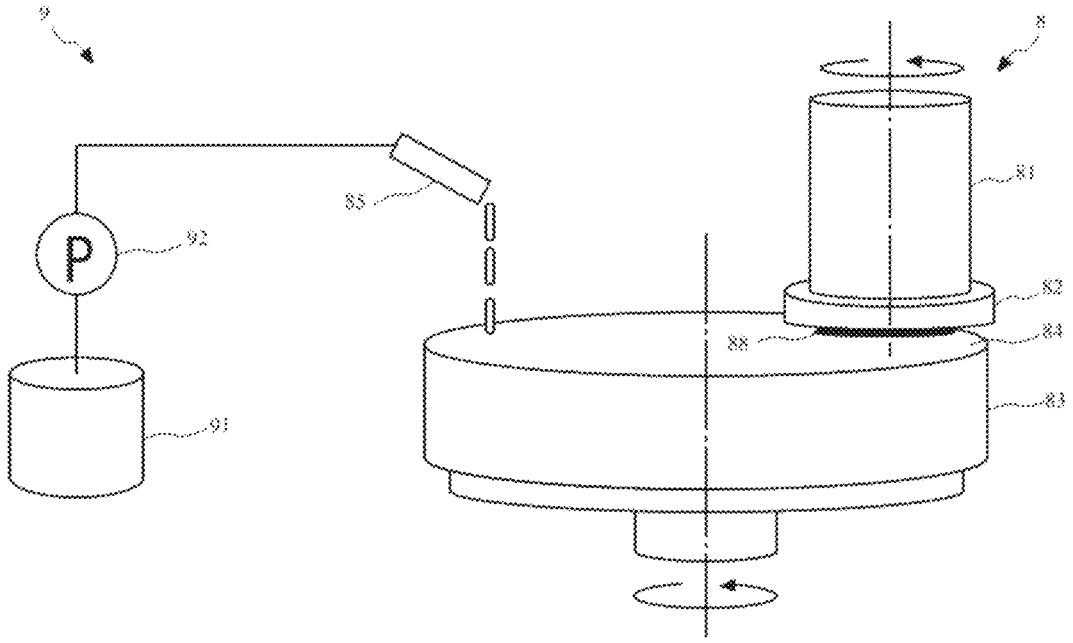
FIG. 8 is a diagram showing a schematic configuration of a conventional CMP system.

(10) In the above first embodiment, the configuration is as follows: the flow channel $\mathbf{10}_{CHM}$ is connected to the inflow port F2 of the mixing unit $\mathbf{50}_{CHM}$, the flow channel $\mathbf{10}_{SLR}$ is connected to the inflow port F2 of the mixing unit $\mathbf{50}_{SLR}$, and the flow channel $\mathbf{10}_{H2O2}$ is connected to the inflow port F2 of the mixing unit $\mathbf{50}_{H2O2}$. However, as shown in FIG. 7, it may be configured that the flow channel $\mathbf{10}_{CHM}$ is connected to the inflow port F1 of the mixing unit $\mathbf{50}_{CHM}$, the flow channel $\mathbf{10}_{SLR}$ is connected to the inflow port F1 of the mixing unit $\mathbf{50}_{SLR}$, and the flow channel $\mathbf{10}_{H2O2}$ is connected to the inflow port F1 of the mixing unit $\mathbf{50}_{H2O2}$.

EXPLANATION OF REFERENCE SYMBOLS

14A gas pressurizing part
15A flow-controller
16A filling amount sensor
17A branching point
21 low-pressure value
29 ultra-pure water inlet
40 blending flow channel
40A flow channel
50A mixing unit
51A case body
52A blending tank
59A stirring device
70 PLC
79 liquid outlet
81 head
82 plate
83 surface plate
84 polishing pad
85 nozzle
88 wafer
89 liquid inlet
91 tank
92 pump

What is claimed is:

1. A polishing liquid supply device that supplies a polishing liquid to a CMP polishing device, the polishing liquid supply device comprising:

a first flow channel transferring slurry;

a second flow channel transferring pure water; and a blending flow channel communicating with the first flow channel and the second flow channel, wherein the blending flow channel is arranged immediately before a liquid outlet that reaches the CMP polishing device, and in the blending flow channel, a plurality of liquids comprising the slurry and the pure water are blended, and the blended liquid is supplied to the CMP polishing device as the polishing liquid, wherein in the blending flow channel, a mixing unit mixing the plurality of liquids comprising the slurry and the pure water is provided, the mixing unit comprises a hollow cylindrical housing, the cylindrical housing comprising:

a first inflow port at a first end of the cylindrical housing, an outflow port at a second end of the cylindrical housing, a second inflow port on a side surface of the cylindrical housing, a stirring screw, a first pipe, and a second pipe, the mixing unit is configured to mix while stirring, a first liquid of the plurality of liquids flowing in from the first inflow port and a second liquid thereof flowing from the second inflow port, by passing through the stirring screw, and the stirring screw comprises:

N twist blades VL-k, wherein N is an integer of 2 or more, and k is an integer in a range from 1 to N, and a shaft rod, wherein the twist blades are arranged at intervals on the shaft rod, and each of the twist blades VL-k has a shape twisted a half turn along an outer peripheral surface of the shaft rod, and wherein the first inflow port communicates with the first pipe in the cylindrical housing, a first tip end of the first pipe is connected to the stirring screw, the second inflow port communicates with the second pipe in the cylindrical housing, the second pipe has a nozzle at the tip end thereof, the nozzle is inserted into the first pipe from the side surface of the first pipe, and in the first pipe, a liquid discharge port of the nozzle faces the stirring screw.

2. The polishing liquid supply device according to claim 1, further comprising:

a drum storing the slurry; and a pump pumping out the slurry in the drum and supplying the slurry to the first flow channel, wherein the first flow channel is a circulation flow channel that returns to the drum via a branching point from the first flow channel toward the blending flow channel.

3. The polishing liquid supply device according to claim 2, further comprising:

at least one pressurizing tank provided between the drum in the first flow channel and the branching point; and a gas pressurizing part that sends out an inert gas to the at least one pressurizing tank and pushes out liquid of the plurality of in the at least one pressurizing tank.

4. The polishing liquid supply device according to claim 3, wherein a number of the at least one pressurizing tank is two or more, and the polishing liquid supply device further comprises:

a controller;

an open/close valve that is provided in at least one port selected from the group consisting of a liquid inflow port and a liquid outflow port of each of the at least one pressurizing tank, wherein the open/close valve opens or closes according to a given signal; and a liquid amount sensor detecting a filled amount of liquid in each of the at least one pressurizing tank and outputting a signal indicating the detected filled amount, wherein the controller recursively repeats a control of closing the open/close valve of the at least one pressurizing tank in which the filled amount becomes less than a decided amount and opening the open/close valve of another of the at least one pressurizing tank having the decided amount for the respective tank.

* * * * *